US006631950B1

(12) United States Patent
Madole

(10) Patent No.: US 6,631,950 B1
(45) Date of Patent: Oct. 14, 2003

(54) PROTECTIVE COVER FOR A HIGH CHAIR

(75) Inventor: Brenda L. Madole, Irvine, CA (US)

(73) Assignee: Balanced Health, Inc., Santa Ana, CA (US)

( * ) Notice: Subject to any disclaimer, the term of this patent is extended or adjusted under 35 U.S.C. 154(b) by 0 days.

(21) Appl. No.: 09/923,782

(22) Filed: Aug. 6, 2001

Related U.S. Application Data

(63) Continuation-in-part of application No. 09/603,164, filed on Jun. 26, 2000, now abandoned.

(51) Int. Cl.[7] ..... A47C 31/00

(52) U.S. Cl. ..... 297/228.11; 297/219.1; 297/153

(58) Field of Search ..... 297/153, 135, 297/148, 224, 219.1, 228.11, 219.12, 228.13; 108/50.14

(56) References Cited

U.S. PATENT DOCUMENTS

| | | | | |
|---|---|---|---|---|
| 179,236 | A | | 6/1876 | Walsh |
| 1,089,279 | A | | 3/1914 | Simer et al. |
| 2,191,956 | A | | 2/1940 | Coldren |
| 2,585,214 | A | | 2/1952 | Belmont |
| 3,168,209 | A | | 2/1965 | Brookins et al. |
| 3,729,037 | A | | 4/1973 | Dare et al. |
| 3,785,419 | A | | 1/1974 | Sherlock |
| 3,788,699 | A | * | 1/1974 | Starr |
| 3,916,447 | A | | 11/1975 | Thompson |
| 4,143,915 | A | * | 3/1979 | Kamlay |
| 4,483,895 | A | | 11/1984 | Deaver |
| 4,627,363 | A | * | 12/1986 | Jones |
| 4,953,704 | A | | 9/1990 | Cortese |
| 5,035,518 | A | * | 7/1991 | McClintock |
| 5,339,748 | A | | 8/1994 | Bilotti |
| 5,354,119 | A | | 10/1994 | Nicholas |
| 5,382,074 | A | * | 1/1995 | Pietra |
| 5,397,162 | A | | 3/1995 | Huang |
| 5,487,587 | A | | 1/1996 | Hylton |
| 5,664,828 | A | * | 9/1997 | Simon |
| 5,908,681 | A | | 6/1999 | Foster |
| 5,915,530 | A | * | 6/1999 | Hager |
| 6,139,097 | A | * | 10/2000 | Yates |
| 6,139,185 | A | | 10/2000 | Hamilton et al. |

* cited by examiner

*Primary Examiner*—Milton Nelson, Jr.
(74) *Attorney, Agent, or Firm*—Stout, Uxa, Buyan & Mullins, LLP; Donald E. Stout

(57) ABSTRACT

A plastic cover is provided for covering and enclosing the tray of a child's high chair, while the tray is disposed over the arms. The cover preferably comprises a water resistant material forming an enclosure, which has an open end and an interior which is accessible through the open end. The tray is disposed within the interior of the enclosure. Use of the plastic tray cover prevents soiling of the tray, simplifying significantly the clean-up process. After use, the cover is removed from the tray and easily washed, or discarded.

22 Claims, 2 Drawing Sheets

PROTECTIVE COVER FOR A HIGH CHAIR

This application is a continuation-in-part of application Ser. No. 09/603,164, entitled Protective Cover for High Chair, filed on Jun. 26, 2000, and now abandoned, which is commonly assigned herewith.

BACKGROUND OF THE INVENTION

This invention relates generally to apparatus and methods for maintaining the cleanliness of a child's high chair, and more particularly to a cover for protecting the tray of such a high chair from soiling during the inevitably messy process of feeding an infant or toddler.

Because infants and toddlers are not sufficiently motor-coordinated to sit up at a dining table, it is, of course, well known to provide for them a high chair, which typically comprises a seating portion, a back rest, a pair of arms, and a tray which is disposed over the arms and secured thereto. The tray functions as an eating surface for the child, and also serves to help restrain the child in the chair. Typically, for safety purposes, particularly for young infants incapable of sitting up on their own, a seat belt is also provided to secure the child in position in the chair.

As any parent is well aware, the process of feeding a child or infant is an exceedingly messy one. In the case of a very small infant, the parent or caregiver typically initiates the feeding, but there is frequently a struggle to successfully get food into the infant's mouth, or the infant spits out food which is in the mouth, creating a very messy tray surface. For older children, who are learning to feed themselves, there is usually substantial spillage of food and drink onto the tray surface as well, necessitating a significant clean-up process.

What is needed, therefore, is a system for protecting the tray surface of the high chair, so that it is not repeatedly impacted by the food and drink spillage which inevitably occurs.

SUMMARY OF THE INVENTION

The present invention solves the foregoing noted problems by providing a convenient cover for a tray of a high chair. The cover comprises a thin, flexible water resistant plastic material which forms an enclosure. The enclosure has an open end and an interior which is accessible through the open end, which interior is sufficiently large to contain the tray therein, such that a top side and a bottom side of the tray are both substantially enclosed by the cover.

Advantageously, a portion of the material which defines the open end is elastomeric, such that the open end of the enclosure may be expanded by pulling outwardly on the material portion, in order to place the tray into the enclosure. However, it is important that the open end returns to its original smaller size when the pulling force is released. The cover is not pre-formed into any particular shape, but is sufficiently flexible to conform freely to a shape of any tray to be covered.

Preferably, the aforementioned elastomeric material comprises an elastic band disposed on the flexible water resistant material circumferentially about the open end. The flexible water resistant plastic material is preferably transparent, in order to provide more pleasing aesthetics. The cover is preferably of a unitary construction, having no separate fastening structure for securing the cover to a high chair tray.

In another aspect of the invention, there is provided a child's high chair, which comprises a seat including a bottom portion, a back rest, and a pair of arms, as well as a tray placeable over the arms to provide an eating surface for the child, which has an upper surface and a lower surface. According to the principles of the invention, a cover is disposed over the tray, while the tray is disposed over the arms. The cover preferably comprises a water resistant material forming an enclosure, which has an open end and an interior which is accessible through the open end, and no pre-formed shape. The tray is disposed within the interior of the enclosure, so that both the upper surface and the lower surface of the tray are substantially more than one-half enclosed by the cover.

Again, it is preferred that a portion of the material which defines the open end be elastomeric, such that the open end may be expanded by pulling outwardly on the material portion. Thus, the tray is placeable into and removable from the interior, wherein the open end returns to its original smaller size when the pulling force is released, so that the cover fits tightly about the tray. Importantly, the high chair needs to be usable as an eating surface while the cover is in place, so a snug fit is required. To attain this snug fit, it is advantageous if the open end can be drawn to a very small size by tightening the elastomeric material. The cover is secured to the tray without the use of any separate fastening elements.

In still another aspect of the invention, there is disclosed a method for protecting the tray of a child's high chair while a child is eating thereon. The method comprises a step of placing a cover which includes an enclosure defined by a flexible water resistant plastic material over the tray while the tray is detached from a remaining portion of the high chair, by passing the tray through an open end of the enclosure until both a top and a bottom surface of the tray are substantially completely within the enclosure. Then, the shape of the cover is conformed to approximate the shape of the tray, after which the tray is attached to the remaining portion of the high chair, so that the tray extends over a pair of arms on the high chair, in an orientation suitable for its intended use.

Preferably, the placing step includes a further step of making the open end substantially smaller once the cover is placed over the tray, so that the cover fits snugly on the tray.

After use of the high chair, the inventive method includes a further step of removing the cover from the tray, and then either washing the cover for reuse, or discarding it.

In still another aspect of the invention, there is provided a tray for a child's high chair, which comprises an upper surface, a lower surface, and attachment hardware for attaching the tray to a high chair. A flexible plastic cover is disposed over both the upper and the lower surface of the tray, such that the tray is substantially entirely enclosed within the cover.

In yet another aspect of the invention, there is provided a protective member for a tray of a high chair, which member comprises a thin, flexible plastic material of sufficient size that a top side and a bottom side of the tray are both substantially covered by the protective member. The protective member, or tray cover, also preferably includes an adhesive tab disposed on a portion of the protective member, for securing the protective member to the tray.

The invention, together with additional features and advantages thereof, may best be understood by reference to the following description taken in conjunction with the accompanying illustrative drawing.

DESCRIPTION OF THE PREFERRED EMBODIMENT

Figure 1:
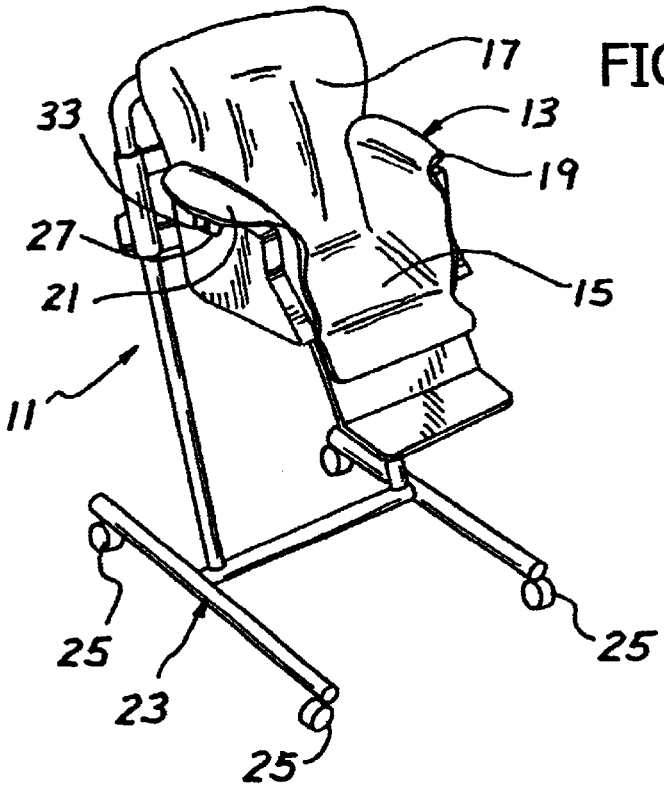
FIG. 1 is a perspective view of a typical child's high chair, with the tray detached.

Referring now more particularly to the drawings, there is shown in FIG. 1 a typical child's high chair 11 of the prior art, which comprises a seat 13, including a bottom portion 15, a back rest 17, and a pair of arms 19 and 21. The seat 13 is supported on a stand 23, which may include castors 25 for facilitating movement of the high chair 11. On the arms 19, 21, tray receiving brackets 27 (only the bracket 27 of the arm 21 is shown) of known construction are provided for receiving a tray 29 (FIG. 3) thereon. These receiving brackets 27 may be of any known type, and typically include both a guide channel for slidably receiving a corresponding attachment bracket 31 on the tray therein, and perhaps an aperture for receiving a mechanical fastener, such as a pin 35 therein, provided on the tray bracket 31, for example, to secure the tray fixedly on the chair 11.

Figure 3:
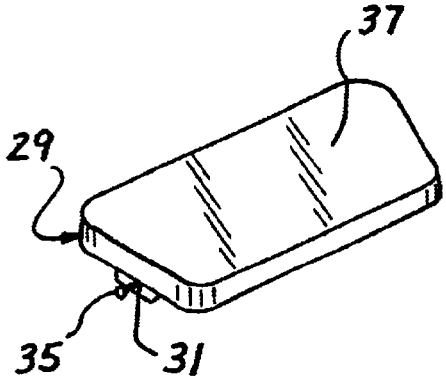
FIG. 3 is a perspective view of a tray usable with the high chair of FIG. 1.

As shown in FIG. 3, and, of course, well known in the art, the tray 29 includes a flat eating surface 37 thereon, to accommodate the child's eating utensils thereon. This surface 37 often becomes extremely soiled during the course of the child's meal, due to the child's typically immature eating habits and undeveloped manual dexterity.

Figure 2:
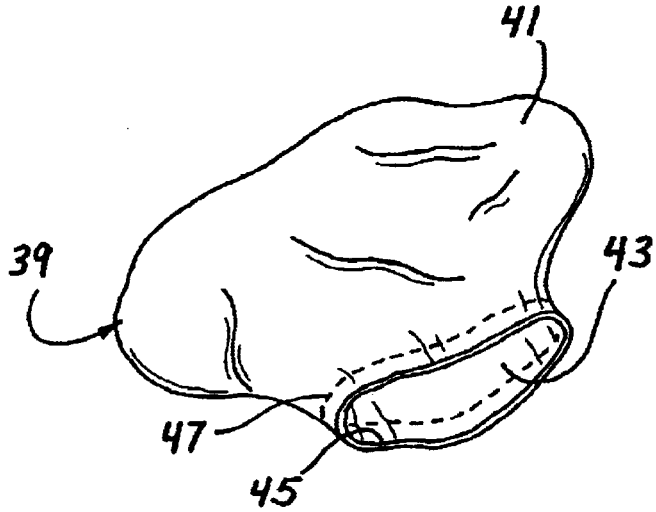
FIG. 2 is a perspective view of a cover fabricated in accordance with the principles of the present invention.

Referring now particularly to FIG. 2, there is illustrated one embodiment of the inventive tray cover 39, constructed in accordance with the principles of the invention. The cover 39 is preferably fabricated of a flexible, thin, water-resistant material, typically plastic which forms an enclosure having an outer wall 41 and an interior 43. The enclosure includes an open end 45 which provides access to the interior 43. Preferably, an elastomeric material 47 is provided about the circumferential edge of the open end 45, so that the size of the open end can be increased by pulling outwardly on the walls defining the open end, but its size will decrease once the pulling force is ceased. In fact, it is within the scope of the invention to provide the elastomeric material, which preferably comprises an elastic band or drawstring fixedly attached to the material in the vicinity of the open end 45, so that the open end can be drawn substantially closed. In one preferred embodiment, the construction of the cover 39 is closely akin to a greatly enlarged shower cap.

Figure 4:
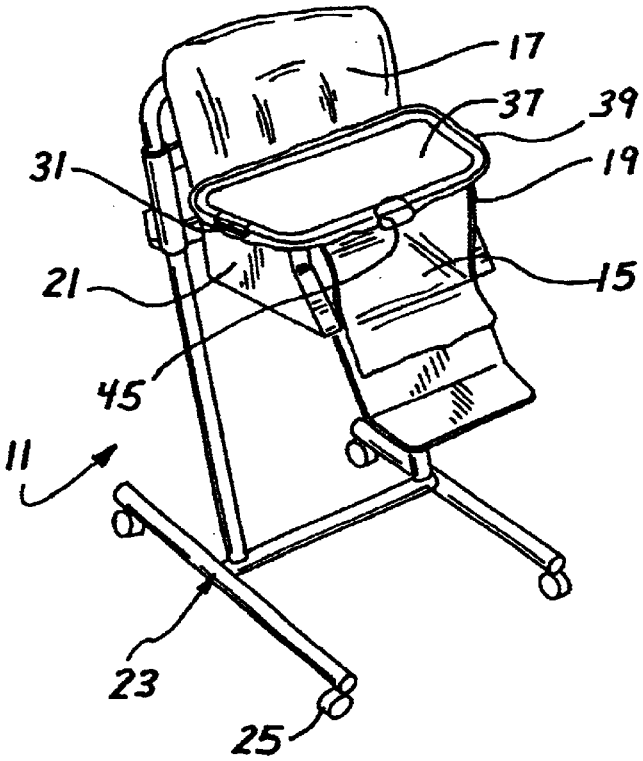
FIG. 4 is a perspective view of the high chair of FIG. 1, with the tray of FIG. 3 attached thereto and disposed within the cover of FIG. 3.

Now with reference to FIG. 4, there is shown the high chair 11 of FIG. 1, wherein the tray 29 of FIG. 3 has been installed thereon, in known fashion. According to the inventive method, while the tray 29 is yet detached from the chair 11, the cover 39 is installed thereon, by expanding the open end 45 of the cover and inserting the tray 29 into the interior 43 of the cover. Once fully inserted, the open end 45 of the cover 39 is drawn down into as small an opening as possible, and the cover 39 itself is fitted as snugly as possible over the tray 29. Then, the tray 29 is installed onto the chair 11.

In the preferred embodiment, the cover 39 is made of a transparent material, so that the tray is fully visible within the interior 43 of the cover, as is illustrated in FIG. 4.

Further in accordance with the inventive method, once the child has completed his or her meal, and has been removed from the chair 11, the tray and cover can be removed from the chair, and the cover further removed from the tray, by increasing the size of the open end 45 and pulling the tray outwardly therethrough. Then, the cover 39 may be cleaned for reuse, or discarded, for a very easy cleanup, as desired.

It should be noted that, in order to simplify the attachment of the tray to the high chair, with the cover inserted over the tray, access openings in the cover 39, for permitting engagement of the bracket 31 on the tray with the bracket 27 on the chair, may be necessary, and are easily put into the outer wall 41 of the cover 39. The access openings may be prefabricated, or simply cut or torn into being by the consumer.

Figure 6:
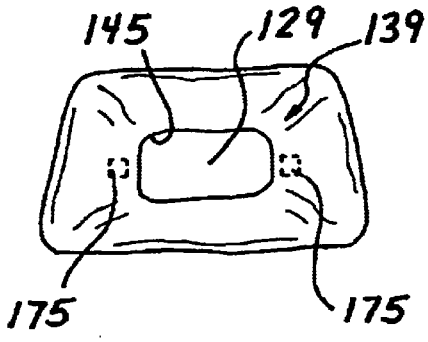
FIG. 6 is a plan view of the underneath surface of a high chair tray such as that shown in FIG. 3, illustrated with the tray cover of FIG. 5 disposed thereon.
Figure 5:
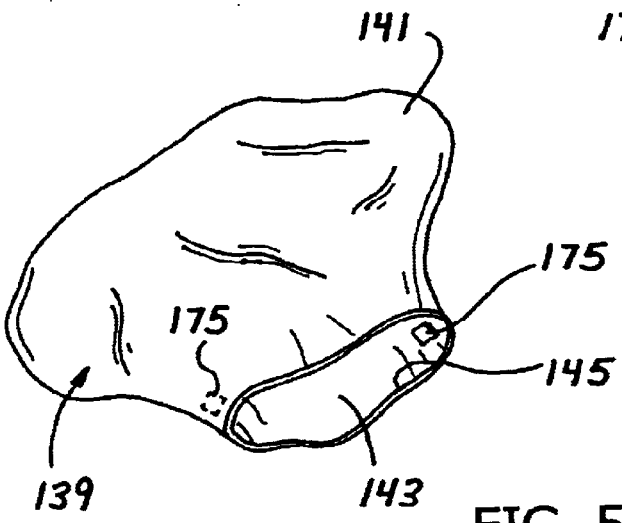
FIG. 5 is perspective view similar to FIG. 2 of a modified tray cover embodiment.

FIGS. 5 and 6 illustrate a modified embodiment of the inventive tray cover, wherein like elements to those illustrated in FIGS. 1–4 are identified by like reference numerals, preceded by the numeral 1. Thus, there is shown a cover 139, formed similarly to the cover 39 of FIG. 2, except that, instead of elastomeric material 47, a plurality of adhesive tabs 175 are disposed on the interior surface 143 of the cover 139, proximate to the opening 145. Two such adhesive tabs 175 are shown, although any number of tabs may be employed. In FIG. 6, the adhesive tabs 175 are shown in phantom, since they are within the cover 139, and thus would not normally be visible in that view. The adhesive tabs 175 are preferably of the type having a removable backing thereon, to prevent the adhesive surface from inadvertently and prematurely contacting and adhering to another surface. Alternatively, the adhesive tab may have an inactive adhesive surface, which may be activated by applying a substance, such as water, thereto. Thus, as shown in FIG. 6, when it is desired to place the cover 139 on the tray 129, the tray 129 is disposed through the opening 145 and into the interior of the cover 139. Then, with the cover 139 covering more than one-half of the lower surface of the tray 129, and the upper surface of the tray being completely covered by the cover 139, the cover is secured in place by removing the removable backing from the adhesive surface on each adhesive tab 175, and then applying the adhesive surface to the lower surface of the tray, so that the cover is immovably secured to the tray.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A cover for a tray of a high chair, said cover comprising a thin, flexible plastic material which forms an enclosure, said enclosure having an open end and an interior which is accessible through said open end, said interior being sufficiently large to contain a high chair tray therein, such that a top side and a bottom side of such a tray are both substantially enclosed by said cover;

a portion of said material which defines said open end being elastomeric, such that said open end may be expanded by pulling outwardly on said material portion, in order to place a high chair tray into said enclosure, but said open end returns to its original smaller size when the pulling force is released; and an adhesive tab disposed on a surface of said cover for contacting and securing said cover to a high chair tray, said adhesive tab having an adhesive surface adapted for contacting another object other than said cover;

wherein said cover is not pre-formed into any particular shape, but is sufficiently flexible to conform freely to a shape of any tray to be covered.

2. The cover as recited in claim 1, wherein said elastomeric material comprises an elastic band disposed on said flexible plastic material circumferentially about said open end.

3. The cover as recited in claim 1, wherein said plastic material is transparent.

4. A tray for a child's high chair, comprising:

an upper surface;

a lower surface;

attachment hardware for attaching the tray to a high chair; and a flexible plastic cover disposed over both the upper and the lower surface of said tray, such that the tray is substantially entirely enclosed within an interior of said cover and each of the upper and lower tray surfaces are thus covered by different portions of said cover;

said flexible plastic cover comprising an open end defined by an elastomeric material, such that said open end may be expanded by applying an outwardly pulling force on said elastomeric material, so that said tray is placeable into and removable from the interior of said cover, wherein said open end returns to its original smaller size when the outwardly pulling force is released, so that the cover fits snugly about said tray.

5. A child's high chair, comprising:

a seat including a bottom portion, a back rest, and a pair of arms;

a tray placeable over said arms to provide an eating surface for the child, and having an upper surface and a lower surface; and a cover disposed over said tray, while said tray is disposed over said arms, said cover comprising a water resistant plastic material forming an enclosure, and having no preformed shape, said enclosure having an open end and an interior which is accessible through said open end, and said tray being disposed within said interior so that both said upper surface and said lower surface of said tray are substantially more than one-half enclosed by said cover;

wherein a portion of said material which defines said open end is elastomeric, such that said open end may be expanded by applying an outwardly pulling force on said material portion, so that said tray is placeable into and removable from said interior, wherein said open end returns to its original smaller size when the outwardly pulling force is released, so that the cover fits snugly about said tray, and said high chair is usable as an eating surface while said cover is in place.

6. The child's high chair as recited in claim 5, wherein said cover is transparent, so that said tray is visible while the cover is in place.

7. The child's high chair as recited in claim 5, wherein said elastomeric material comprises an elastic band disposed on said water resistant material circumferentially about said open end.

8. The child's high chair as recited in claim 5 wherein said open end can be drawn to a very small size by tightening said elastomeric material.

9. The child's high chair as recited in claim 5, wherein the cover is secured to said tray without the use of any separate fastening elements.

10. The child's high chair as recited in claim 5, and further comprising an adhesive tab disposed on a surface of said cover for contacting and securing said cover to said tray.

11. The child's high chair as recited in claim 10, wherein said adhesive tab has a removable backing disposed thereon.

12. A child's high chair, comprising:

a seat including a bottom portion, a back rest, and a pair of arms;

a tray placeable over said arms to provide an eating surface for the child, and having an upper surface and a lower surface; and a transparent cover disposed over said tray, while said tray is disposed over said arms, said cover comprising a water resistant plastic material forming an enclosure, and having no preformed shape, said enclosure having an open end and an interior which is accessible through said open end, and said tray being disposed within said interior so that both said upper surface and said lower surface of said tray are substantially more than one-half enclosed by said cover.

13. A method for protecting a tray of a child's high chair while a child is eating thereon, said method comprising:

placing a cover which includes an enclosure defined by a flexible water resistant material over said tray while said tray is detached from a remaining portion of said high chair, by passing said tray through an open end of said enclosure until both a top and a bottom surface of said tray are substantially completely within said enclosure, such that both said top and bottom surfaces are covered by different portions of said cover;

conforming a shape of said cover to approximate a shape of said tray, including making said open end substantially smaller once the cover is placed over the tray, so that the cover fits snugly on said tray; and attaching said tray to the remaining portion of said high chair, so that said tray extends over a pair of arms on said high chair, in an orientation suitable for its intended use.

14. The method as recited in claim 13, wherein said cover comprises a plastic material.

15. The method as recited in claim 13, wherein said cover is transparent.

16. The method as recited in claim 13, wherein said method does not include a step of securing the cover to the tray using separate fastening apparatus.

17. The method as recited in claim 13, and further including a step of removing said cover from said tray after use.

18. The method as recited in claim 17, and further including a step of washing said cover.

19. The method as recited in claim 17, and further including a step of discarding said cover.

20. A child's high chair, comprising:

a seat including a bottom portion, a back rest, and a pair of arms;

a tray placeable over said arms to provide an eating surface for the child, and having an upper surface and a lower surface;

a cover disposed over said tray, while said tray is disposed over said arms, said cover comprising a water resistant plastic material forming an enclosure, and having no preformed shape, said enclosure having an open end and an interior which is accessible through said open end, and said tray being disposed within said interior so that both said upper surface and said lower surface of said tray are substantially more than one-half enclosed by said cover; and an adhesive tab disposed on a surface of said cover for contacting and securing said cover to said tray.

21. The child's high chair as recited in claim 20, wherein said adhesive tab has a removable backing disposed thereon.

22. A method for protecting a tray of a child's high chair while a child is eating thereon, said method comprising:

placing a transparent cover which includes an enclosure defined by a flexible water resistant material over said tray while said tray is detached from a remaining portion of said high chair, by passing said tray through an open end of said enclosure until both a top and a bottom surface of said tray are substantially completely within said enclosure, such that both said top and bottom surfaces are covered by different portions of said cover;

conforming a shape of said cover to approximate a shape of said tray; and attaching said tray to the remaining portion of said high chair, so that said tray extends over a pair of arms on said high chair, in an orientation suitable for its intended use.

* * * * *